United States Patent [19]

Witter et al.

[11] Patent Number: 4,533,515

[45] Date of Patent: Aug. 6, 1985

[54] METHOD EMPLOYING STEAM TO STERILIZE PACKAGING MATERIAL

[75] Inventors: Karl-Theo Witter; Peter Friedrich, both of Linnich; Ulrich Ströle, Titz, all of Fed. Rep. of Germany

[73] Assignee: Papier-und Kunststoff-Werke Linnich GmbH, Dusseldorf, Fed. Rep. of Germany

[21] Appl. No.: 592,727

[22] Filed: Mar. 22, 1984

Related U.S. Application Data

[63] Continuation of Ser. No. 322,121, Nov. 17, 1981, abandoned.

[30] Foreign Application Priority Data

Nov. 22, 1980 [DE] Fed. Rep. of Germany ..... 3044061

[51] Int. Cl.[3] ..... E04B 2/00

[52] U.S. Cl. ..... 422/26; 53/425; 53/426; 422/304; 426/399; 426/400; 426/401; 426/407

[58] Field of Search ..... 422/26, 304; 53/425, 53/426; 426/399, 400, 401, 407

[56] References Cited

U.S. PATENT DOCUMENTS

| | | | |
|---|---|---|---|
| Re. 22,832 | 1/1947 | Meyerson | 422/26 X |
| 2,660,513 | 11/1953 | Ball | 422/26 |
| 3,091,901 | 6/1963 | Silverstolpe | 53/425 |
| 3,352,629 | 11/1967 | Iverson | 422/304 X |
| 3,438,790 | 4/1969 | Barnby | 426/399 |
| 4,152,464 | 5/1979 | Brody et al. | 426/413 |

FOREIGN PATENT DOCUMENTS

| | | | |
|---|---|---|---|
| 160469 | 12/1951 | Australia | 422/304 |
| 712994 | 7/1965 | Canada | 426/399 |
| 587056 | 4/1947 | United Kingdom | 422/304 |
| 693518 | 7/1953 | United Kingdom | 422/304 |

*Primary Examiner*—Robert Lindsay

*Attorney, Agent, or Firm*—Sprung Horn Kramer & Woods

[57] ABSTRACT

In the steam sterilization of packaging material, such as blanks intended for containers of acid liquids, the improvement which comprises employing a packaging material with a surface germ-count of less than approximately 1 germ/dm$^2$ and using steam at atmospheric pressure. The packaging material can comprise a reel of fibrous material coated on one or both surfaces with plastic or it can comprise plastic-coated containers. After steaming, it may be hot air dried.

4 Claims, 1 Drawing Figure

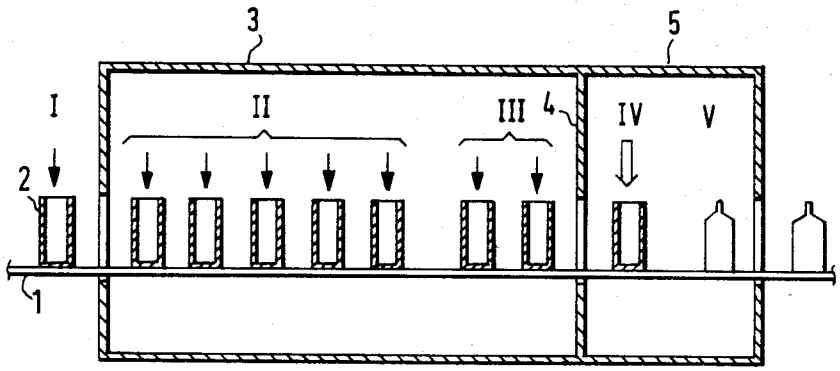
3
5
I
II
III
4
IV
V
2
1

METHOD EMPLOYING STEAM TO STERILIZE PACKAGING MATERIAL

This application is a continuation of application Ser. No. 322,121, filed 11/17/81 abandoned.

The invention concerns a method employing hot steam to sterilize packaging material, especially containers manufactured from blanks and intended for holding acid contents like fruit juice.

The packaging of food and nutrients like milk, fruit juice, etc. entails strict demands on the sterility of the surfaces of the packaging material that come into contact with the contents. The brief time of approximately a few seconds that can be devoted to sterilization when such containers are being automatically filled makes these demands all the more difficult to satisfy. Although the employment of hot steam to sterilize such surfaces has been known for a long time, the opinion has long prevailed in the food-packaging industry that steam sterilization can only be carried out at temperatures ranging from 125° to 150° C., meaning that it must take place under an increased pressure of approximately 2.4 to 5 bar. Such conditions however make the sterilization process considerably more expensive because the sterilizer through which the packaging material travels must be sealed off from the environment and pressurized. The high temperatures also subject the packaging material itself to excessive strain.

A tremendous number of expedients has been attempted, mainly directed toward the application of cool or warm aqueous solutions of chemical bactericides or processes involving both chemicals and hot steam under somewhat lower pressures. Special attention must then be devoted however to the strict legal requirement that none of the bactericide remain on the surface of the packaging material when the containers are filled, which presents no small problem because they contain interior angles and corners.

There exists therefor a real need for a method of sterilizing packaging material that will involve little capital outlay and no chemicals.

The invention is a proposal for a method of sterilization with hot steam, characterized in that a packaging material with a surface germ-count of less than approximately 1 germ/dm$^2$ is employed and treated with steam under atmospheric pressure.

In contrast to the concept prevailing in the food-packaging industry that steam is of little effect for sterilization in open systems, under normal pressure and especially in the presence of air that is, and is absolutely useless when the available time is as short as when containers are being filled automatically, it has been demonstrated that hot steam can be employed under normal pressure to aseptically fill pasteurized, especially acid, liquids satisfactorily if the packaging material has a surface germ count of less than approximately 1 germ/dm$^2$. The purpose of the invention is approached therefore, not only from the aspect of what germicide to employ but also from that of a particular type of packaging material.

The packaging material in question will consist specifically of plastic film or of a fibrous material like cardboard that has been extrusion-coated on both sides with plastic and wrapped on a reel. Such material will, because it is manufactured with an originally liquid plastic, have already been subjected to heat treatment involving dry heat at a temperature ranging from 200° to 300° C.

The feedstock of the method in accordance with the present invention will therefore already be germ-free. It will of course not remain completely sterile while being processed into a reel-wound product or into blanks, but careful handling can ensure that its average surface germ-count remains less than 1 germ/dm$^2$. The heat treatment mentioned above is especially effective in completely killing yeasts and mildews and other live germs, so that the remaining organisms will essentially consist of sporiferous flora. The surface count of yeasts and mildew is of course obviously lower, at less than 0.1 germ/dm$^2$, that that of total germs.

Since the preferred packaging material, which is cardboard that has been extrusion-coated on both sides with plastic, is coated immediately after extrusion at a temperaure ranging from 250° C. to 320° C., both sides will be coated practically germ-free. Since further processing occurs at high speeds and almost completely automatically, with manual handling reduced to a minimum, whether the material is transferred from reel to reel or taken off a reel and cut into blanks, it will thus be exposed only briefly to the ambient air. Furthermore, the blanks are packed in a carton that is sealed tightly enough to minimize later contamination of the surfaces that will make up the inside of the finished container. Sterile packaging material with a mean surface germ-count of less than 1 germ/dm$^2$ and appropriate for utilization within the context of the invention can thus be delivered to the packaging device. Any individual germs that can be demonstrated inside the finished container will derive essentially from the dry ambient air of the processing plant and will consist mainly of sporiferous organisms. The frequency of yeasts and mildews or other types of germ that are critical for acid contents is very low, below 0.1 germ/dm$^2$ as already mentioned.

The method in accordance with the invention can be carried out with a continuous web of the packaging material being subjected to flowing steam. The web can be treated continuously or intermittently with saturated steam as it comes off the reel and then dried with hot air, which will prevent outside contamination if necessary. Arrangements can be made if necessary to protect the edges of the web from the effects of damp heat. The web can be subsequently processed by known methods, but with provisions to maintain extensive sterility, into blanks or into finished containers and delivered for filling.

When finished packages are to be sterilized, the saturated steam is admitted into the open package at one or more stations of the filling system. The steam should flow at a rate sufficient to expel as much air as possible from the container. The condensing steam should produce a thin film of water that is as continuous as possible on the inner surface of the container and at 90° to 100° C. Large drops or aggregations of condensate on the bottom of the container should be avoided. This can be controlled by carefully adjusting the amount of steam and its rate of flow to the form and wall temperatures of the container.

The steam will take about 3 to 10 seconds to take effect, a time determined by the cycle of the filling device. It may be practical to air-heat the inner surface of the container to above 60° C. before the steam is introduced to promote the formation of a thin film. It may also be practical to dry the inside of the container with hot air after steam treatment.

The method in accordance with the invention is especially appropriate for acid contents with a pH below 4 that have been pasteurized before being poured into the containers. The temperature and duration of pasteurization depend on the type of contents. Examples of especially appropriate contents are apple, orange, tomato, and other fruit juices or fruit juice-based drinks. Sour-milk products like yogurt and sour cream will also keep very well when packed by this method.

The most important advantages of the method in accordance with the invention are that no expense is involved in removing residual bactericide from the containers before they are filled and that no pressurized sterilizers that have to be sealed off from the environment are necessary.

The invention will now be described in detail with reference to the attached drawing, which is a strictly diagrammatic illustration of the sterilization and filling sections of a container-filling machine on which the method in accordance with the invention is carried out.

Containers 2 are conveyed on a compartmentalized belt or similar device along a supply section 1 and through a sterile space 3. A sterile atmosphere is maintained in space 3 by the known method of pumping in a laminar flow of sterile air. A wall 4, which has an opening with dimensions that will just allow containers 2 to pass through, separates sterile space 3 from a space 5 that is also kept sterile and in which containers 2 are filled with the contents and closed.

Containers 2 are made of a cardboard manufactured out of bleached cellulose fibers that has been extrusion-coated on both sides with plastic. Aluminum foil has also been inserted between one polyethylene layer and another, outer, polyethylene layer, on the side of the cardboard that will later be in contact with the contents, while the cardboard was still in the form of a web, so that the web consists of a series of layers in the sequence polyethylene-cardboard-polyethylene-aluminum-polyethylene. Since polyethylene that is to be extruded is heated in the extruder to between 250° and 320° C., it will be practically germ-free as it leaves the die and will cover both sides of the cardboard in a sterile layer. The web will then be cut as described above into carton blanks with a final surface germ-count of less than 1 germ/$cm^2$.

The blanks are now automatically made into containers right in the filling machine by folding up the sides and bonding the seams. Regular cleaning and disinfection ensure that the parts of the maching (holding arbors, folder fingers, etc.) that come into contact with the surfaces that will later form part of the inside of the container will not infect them.

Air that has been heated to 100° to 200° C. is blown into containers 2 at this stage in a preheating station I until the inner surface of the containers heats up to 60° to 80° C. After entering sterile space 3 the containers arrive at a sterilization station II that comprises five cycle stations. Saturated steam is blown into containers 2 at station II in a sequence of five cycles of one to two seconds each and in volumes at least ten times the volume of a container. Because the containers have been preheated in station I, a film of water will now form on the inner surface of the containers, sterilizing them perfectly, provided that the packaging material has been selected in accordance with the invention.

Air that has been heated to 150° to 200° C. is now blown into containers 2 in a hot-air station III that comprises two cycles, drying the inner surface of the containers. The small amount of condensed water that may remain on the bottom of the containers can be ignored because it is perfectly sterile.

The contents are poured into containers 2 at a filling station IV.

The tops of containers 2 are hermetically hot-bonded or ultrasonically sealed at a sealing station V.

Excess steam from sterilization station II is pumped out of sterile space 3. It can be reused, to transfer heat to the air employed at preheating station I, for example.

Although the method in accordance with the invention has been illustrated with an embodiment employing cardboard that has been extrusion-coated on both sides with polyethylene as the preferred packaging material, the invention must by no means be considered as restricted to embodiments employing that material. Materials with germ counts ranging from low to zero can also be obtained with plastic-dispersion coats, of PVDC for example. When coats of such dispersions, especially those that have been made sour, are dried, they will be just as sterile as those that have been extruded. It will be understood that the specification and examples are illustrative but not limitative of the present invention and that other embodiments within the spirit and scope of the invention will suggest themselves to those skilled in the art.

I claim:

1. In the steam sterilization of packaging material, such as blanks intended for containers of acid liquids, the improvement which comprises employing a packaging material with a surface germ-count of less than approximately 1 germ/$dm^2$, forming the packaging material with a surface germ-count of less than approximately 1 germ/$dm^2$ into open containers, preheating the surfaces of the containers to 60° to 80° C. with air at 100° to 200° C., placing the containers into a sterile space after preheating, completing sterilization in the sterile space by treating the containers solely with steam at atmospheric pressure for 3 to 10 seconds including blowing the steam into the container in a sequence of five cycles of one to two seconds each in volumes of at least ten times that of the container and forming by condensation a thin film of water on the inner surface of the container that is as continuous as possible and that has a temperature of 90° to 100° C., drying the sterilized containers in the sterile space with sterile hot air at 150°–200° C. and filling the completely sterilized containers in a separate space and sealing the filled containers.

2. The process according to claim 1, wherein the packaging material comprises a reel of fibrous material which has been extrusion-coated on both surfaces with plastic.

3. The process according to claim 1, wherein the packaging material comprises a reel of fibrous material which has been coated on at least one surface with a plastic dispersion.

4. The process according to claim 1, wherein the containers are placed upright into the sterile space with the open end at the top.

* * * * *